US006216917B1

(12) United States Patent
Crouch

(10) Patent No.: US 6,216,917 B1
(45) Date of Patent: Apr. 17, 2001

(54) DISPENSING SYSTEM AND METHOD

(75) Inventor: Kenneth C. Crouch, North Andover, MA (US)

(73) Assignee: Speedline Technologies, Inc., Haverhill, MA (US)

( * ) Notice: Subject to any disclaimer, the term of this patent is extended or adjusted under 35 U.S.C. 154(b) by 0 days.

(21) Appl. No.: 09/351,697

(22) Filed: Jul. 13, 1999

(51) Int. Cl.[7] ..... B67D 5/62
(52) U.S. Cl. ..... 222/146.5; 137/884
(58) Field of Search ..... 222/146.5; 137/884, 137/341

(56) References Cited

U.S. PATENT DOCUMENTS

| | | | | |
|---|---|---|---|---|
| 3,495,604 | * | 2/1970 | Trask | 137/15 |
| 4,269,212 | * | 5/1981 | Kaartinen | 137/13 |
| 4,542,162 | * | 9/1985 | Rutherford et al. | 521/211 |
| 4,907,950 | | 3/1990 | Pierrat | 417/271 |
| 5,004,404 | | 4/1991 | Pierrat | 917/53 |
| 5,551,481 | * | 9/1996 | Elrad, Jr. | 137/625.65 |

FOREIGN PATENT DOCUMENTS

| | | | | |
|---|---|---|---|---|
| 0767413 | * | 9/1980 | (SU) | 137/884 |

* cited by examiner

*Primary Examiner*—Joseph A. Kaufman
*Assistant Examiner*—Melvin A. Cartagena
(74) *Attorney, Agent, or Firm*—Mintz, Levin, Cohn, Ferris, Glovsky and Popeo, P.C.

(57) ABSTRACT

Aspects of the present invention are directed to methods and apparatus for dispensing material onto substrates. A dispensing pump is provided for dispensing a metered quantity of material onto a substrate, the dispensing pump includes an inlet for receiving dispensing material, an outlet from which the dispensing material is dispensed, a dispensing apparatus having a plurality of inputs and a plurality of outputs, a motor, coupled to the dispensing apparatus that controls flow of material from the plurality of inputs in the dispensing apparatus to the plurality of outputs in the dispensing apparatus, and a distribution apparatus coupled to the dispensing apparatus to transfer material from the inlet to the plurality of inputs and to transfer material from the plurality of outputs to the outlet, the distribution apparatus including a plurality of plates coupled together to form the distribution apparatus.

13 Claims, 2 Drawing Sheets

DISPENSING SYSTEM AND METHOD

FIELD OF THE INVENTION

The present invention relates generally to a method and apparatus for dispensing material onto a substrate, and more specifically, to variable volume positive displacement systems and methods.

BACKGROUND OF THE INVENTION

There are several types of prior art dispensing systems used for dispensing metered amounts of liquid or paste for a variety of applications. One such application is in the assembly of printed circuit boards and integrated circuit chips. In this application, dispensing systems are used in the process of encapsulating integrated circuits with an encapsulating material and in the process of underfilling flip integrated circuit chips with an encapsulent. Prior art dispensing systems are also used for dispensing dots or balls of liquid epoxy or solder onto circuit boards and integrated circuits. The liquid epoxy and solder is used to connect components to a circuit board or to an integrated circuit. The dispensing systems described above include those manufactured and distributed by Speedline Technologies, Inc, the assignee of the present invention.

It is desirable to use positive displacement pumps in dispensing systems to effectively control the volume of material dispensed. U.S. Pat. Nos. 4,907,950 and 5,004,404 to Pierrat, which are incorporated herein by reference, disclose positive displacement pumps used to dispense variable quantities of material. The pumps disclosed by Pierrat include a crank-shaft drive that drives a number of pistons and cylinders to couple pressurized material at an inlet of the pump to an outlet of the pump to dispense the material. The pumps disclosed by Pierrat have up to four cylinders, each of which has an inlet port and an outlet port that are respectively coupled on a time-shared basis to the inlet and the outlet of the pump to provide dispensing.

Typical prior art pumps include a material distribution block to distribute material from the inlet of the pump to each of the inlet ports of the cylinders and from each of the outlet ports of the cylinders to the outlet of the pump. These distribution blocks are typically one piece blocks, constructed from a solid block of plastic or stainless steel, and have a number of passages drilled in the blocks to couple the inlet of the pump to each of the inlet ports and to couple each of the outlet ports to the outlet of the pump. For a pump having four cylinders, the distribution block typically has eight passages formed therein. The eight passages are coupled between 10 openings in the distribution block. Four of the openings are inlet port openings to couple to the inlet ports of the cylinders, four are outlet port openings to couple to the outlet ports of the cylinders, one of the openings is an inlet opening to couple to the inlet of the pump, and one of the openings is an outlet opening to couple to the outlet of the pump. Four of the eight passages are inlet passages that extend from one of the inlet port openings to the inlet opening, and the other four passages are outlet passages that extend from one of the outlet port openings to the outlet port.

While the distribution blocks are effective in distributing material between the cylinders and the inlet and the outlet on the pump, it is desirable to provide a distribution block that is less expensive to manufacture, and easier to clean. For some dispensing materials, such as those used in the assembly of printed circuit boards and integrated circuit chips, it is typically necessary to clean the dispensing material from a dispensing pump on a periodic basis to prevent dried material from clogging the pump.

SUMMARY OF THE INVENTION

A first aspect of the present invention is directed to a dispensing pump for dispensing a metered quantity of material onto a substrate. The dispensing pump includes an inlet for receiving dispensing material, an outlet from which the dispensing material is dispensed, a dispensing apparatus having a plurality of inputs and a plurality of outputs, a motor, coupled to the dispensing apparatus that controls flow of material from the plurality of inputs in the dispensing apparatus to the plurality of outputs in the dispensing apparatus, and a distribution apparatus coupled to the dispensing apparatus to transfer material from the inlet to the plurality of inputs and to transfer material from the plurality of outputs to the outlet. The distribution apparatus includes a plurality of plates coupled together to form the distribution apparatus.

At least one of the plurality of plates may include a heater to heat the dispensing material. The distribution apparatus may include a first plate that has an inlet channel extending from the inlet to a junction point and a plurality of concave channels formed in a first surface of the plate and extending from the junction point to couple the inlet to each of the plurality of inputs. The distribution apparatus can further include a second plate having a first surface mated with the first surface of the first plate to enclose each of the concave channels. The second plate may have a second surface having a plurality of concave channels extending from a junction point to couple each of the plurality of outputs to the junction point. The third plate may have a first surface mated with the second surface of the second plate to enclose each of the concave channels of the second plate. The third plate may further include a second surface substantially parallel to the first surface and include an output channel aligned with the junction point of the second plate and extending from the first surface of the third plate to the second surface of the third plate.

Another aspect of the present invention is directed to a method of dispensing material from a dispensing apparatus having a plurality of inputs and a plurality of outputs, and a motor that controls flow of material from the plurality of inputs to the plurality of outputs. The method includes steps of coupling a plurality of plates to the dispensing apparatus, the plurality of plates forming a plurality of channels to couple the plurality of inputs to a single material input and to couple the plurality of outputs to a single material output, applying dispensing material to the single material input, and dispensing material from the single material output. The method may further include steps of disassembling the plates from the dispensing apparatus and cleaning the dispensing material from the plates. The method may also include a step of heating the dispensing material in the plurality of plates.

Another aspect of the present invention is directed to a dispensing pump for dispensing a metered quantity of material onto a substrate, the dispensing pump includes an inlet for receiving dispensing material, an outlet from which the dispensing material is dispensed, a dispensing apparatus having a plurality of inputs and a plurality of outputs, a motor, coupled to the dispensing apparatus that controls flow of material from the plurality of inputs in the dispensing apparatus to the plurality of outputs in the dispensing apparatus, and means for transferring material from the inlet to the plurality of inputs and for transferring material from the plurality of outputs to the outlet, the means for transferring including a plurality of sections coupled together to form a plurality of distribution channels.

The dispensing pump may further include means for heating the dispensing material in the means for transferring.

BRIEF DESCRIPTION OF THE DRAWINGS

For a better understanding of the present invention, reference is made to the drawings which are incorporated herein by reference and in which.

DETAILED DESCRIPTION

Figure 2:
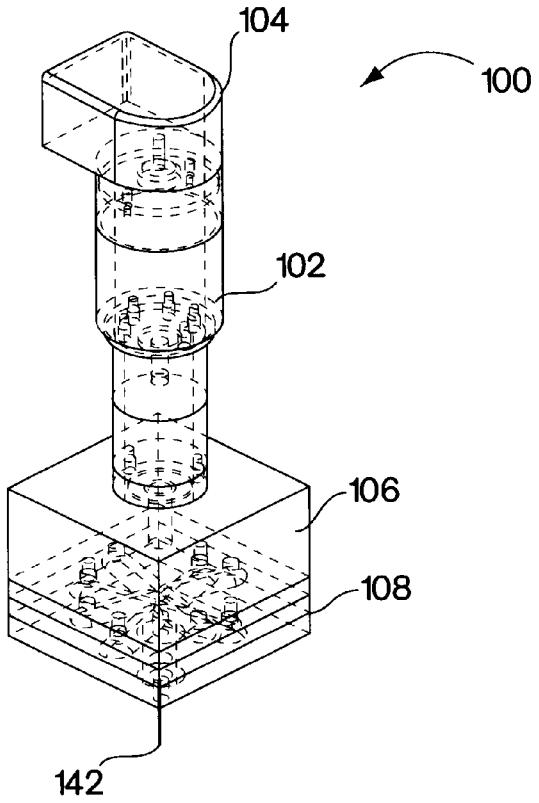
FIG. 2 is a perspective view of a portion of the dispensing pump of FIG. 1 showing a distribution block of the dispensing pump in greater detail.
Figure 3:
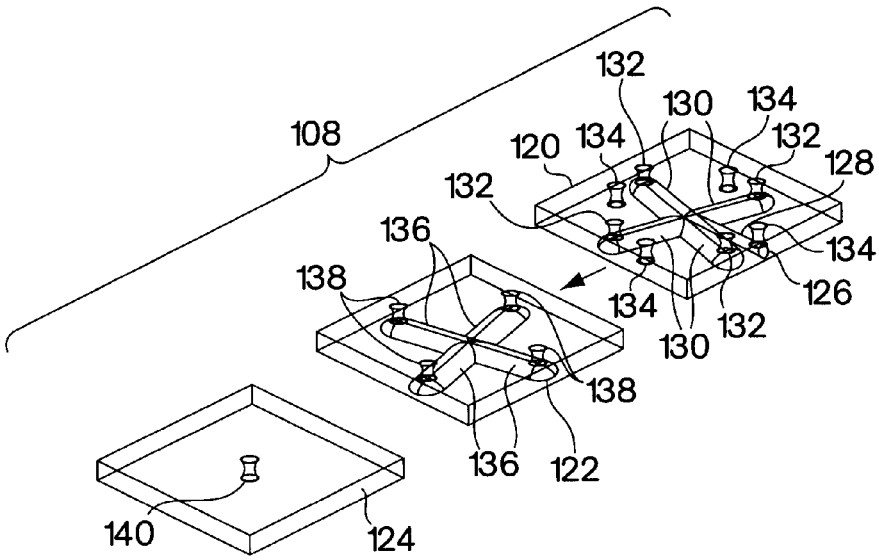
FIG. 3 is an exploded view of the distribution block used with the pump of FIG. 1.

A first embodiment of a positive displacement dispensing pump 100 of the present invention will now be described with reference to FIGS. 1–3. The positive displacement dispensing pump 100 includes a servo motor 102, an encoder 104, a cylinder housing 106, a distribution block 108, a first bracket 110 for mounting the pump 100 to a dispensing system, a syringe 112, a syringe bracket 114, and a syringe block 116.

The encoder 104 is designed to couple with a control system of a dispensing system to coordinate transfer of control signals between the control system and the servo motor 102 of the dispensing pump. The servo motor 102 may be implemented using one of a number of known motors. The servo motor is the primary drive motor of the dispensing pump 100 and controls movement of cylinders contained within the cylinder housing 106. The cylinder housing 106, in one embodiment of the present invention, contains a number of cylinders and pistons coupled to a crankshaft which in turn is coupled to the servo motor 102. In one embodiment of the present invention, the cylinder housing contains four cylinders and four pistons and is implemented using one of the techniques described in U.S. Pat. Nos. 4,907,950 and 5,004,404 discussed above. In other embodiments, the cylinder housing may contain more or less than four cylinders and pistons and may include a cam coupled to the servo motor that is designed to provide continuous flow of material from the dispensing pump.

The syringe 112 contains the material to be dispensed by the dispensing pump. The syringe is held in place using the syringe bracket 114 and syringe block 116. The syringe has a cap 118 that has a pressurized air inlet 120 for coupling to a pressurized air source to apply pressure to the material in the syringe. The syringe block 116 includes a material passage to provide material flow between the syringe and the inlet of the distribution block. In one embodiment, the syringe block may contain heating elements to control the temperature of material being dispensed. For many applications, it is desirable to control the temperature of the dispensing material to provide a consistent viscosity which helps to improve the dispensing accuracy of the pump.

The distribution block 108 includes three distribution plates including an upper distribution plate 120, an intermediate distribution plate 122 and a lower distribution plate 124. The upper distribution plate includes a material inlet 126, an inlet channel 128, four inlet distribution channels 130, four inlet port openings 132 and four outlet port openings 134. The distribution channels are formed as grooves in the lower surface of the upper distribution plate. The upper surface of the intermediate distribution plate forms a bottom surface of each of the inlet distribution channels to contain material in the channels. Each of the inlet port openings extends from one end of one of the distribution channels through the upper distribution plate to the top surface of the upper distribution plate. Each of the outlet port openings extends from the top surface of the upper distribution plate to the bottom surface of the upper distribution plate.

The intermediate distribution plate 122 has a substantially smooth upper surface, four outlet distribution channels 136, and four openings 138. Each of the four openings 138 extends from the upper surface of the intermediate distribution plate to one end of one of the distribution channels 136. Each of the openings 138 is aligned with a corresponding one of the outlet port openings of the upper distribution plate. The outlet distribution channels 136 are formed as grooves in the lower surface of the intermediate distribution plate. The upper surface of the lower distribution plate forms a bottom surface of each of the outlet distribution channels.

The lower distribution plate 124 has a substantially smooth upper surface, a substantially smooth lower surface and a material outlet channel 140 that extends from the upper surface to the lower surface. The material outlet channel is aligned with a junction point of the four outlet distribution channels of the intermediate distribution plate.

In one embodiment of the present invention, the three distribution plates are held together and are coupled to the cylinder housing using cap screws.

The flow of material through the distribution block 108 during operation of the pump 100 will now be described. The material inlet receives dispensing material from the syringe block 116, and the material flows through the inlet channel 128 through the four inlet distribution channels, the inlet port openings and into the inlet ports of the cylinder housing. Each of the outlet port openings 134 receives material from one of the outlet ports of the cylinder housing, and the material flows through the outlet port openings to the outlet distribution channels 136. Material flows through the outlet distribution channels to the material outlet channel 140, and is dispensed through the dispensing needle 142.

Figure 1:
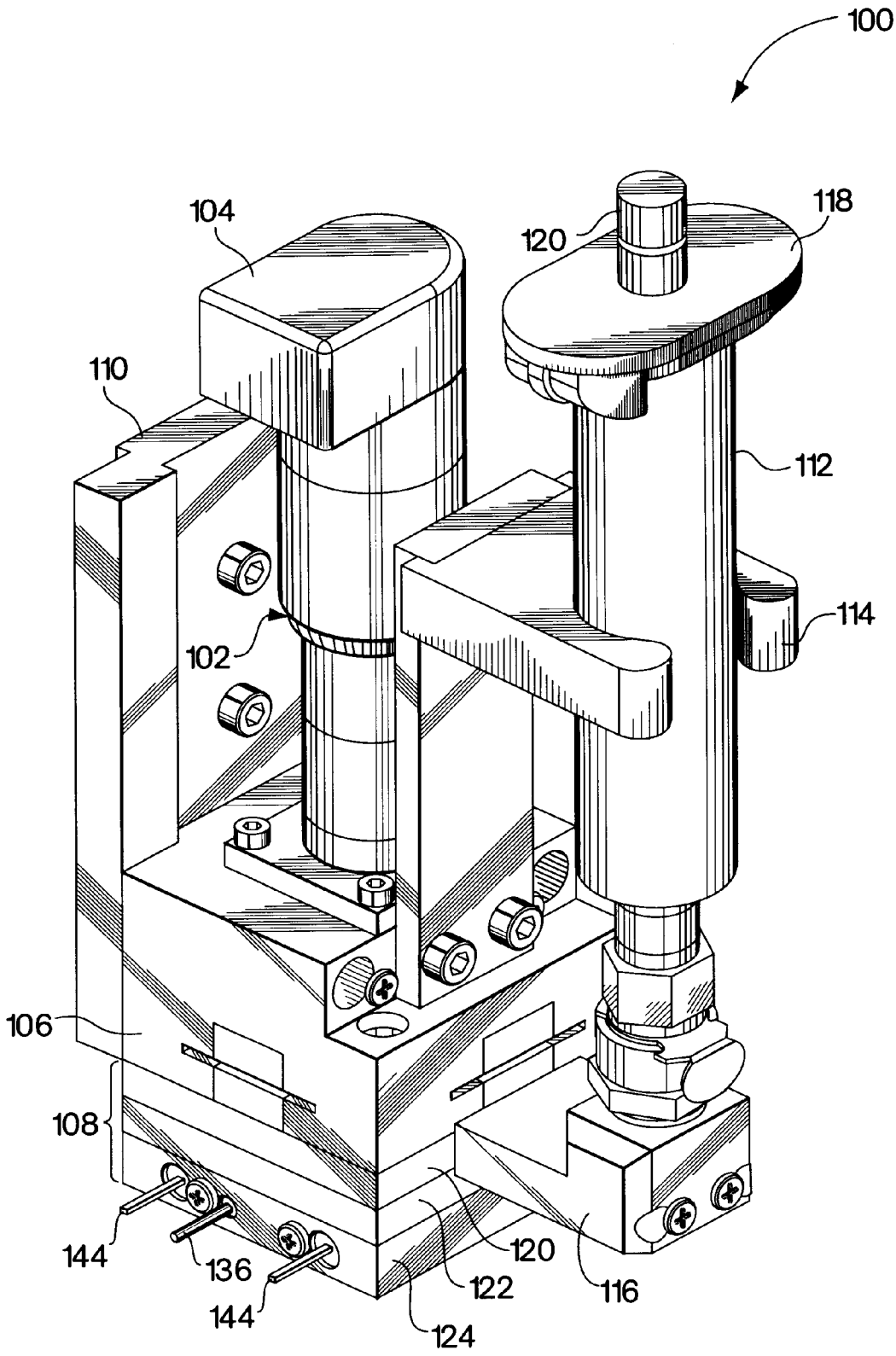
FIG. 1 is a perspective view of a dispensing pump in accordance with one embodiment of the present invention.

As shown in FIG. 1, the distribution block 108 may contain one or more heaters 144 and thermocouples 146 to control the temperature of material being dispensed. The use of multiple plates in the distribution block makes it easier to install heaters and thermocouples in the distribution block. In the embodiment shown, the heaters and thermocouples are included in the lower distribution plate only. However in other embodiments, heaters and thermocouples may be included in the other distribution plates, in addition to, or in place of the heaters and thermocouples contained in the lower distribution plate.

The three plate distribution block used with embodiments of the present invention described above provides several advantages over prior art distribution blocks. First, they are easier to manufacture since channels of extended length need not be drilled into a block of material. In addition, distribution blocks of the present invention are easier to clean. When it is desired to clean the distribution block 108, the distribution block is removed from the pump and disassembled into the three plates shown in FIG. 3. With the plates disassembled, it is easy to completely wipe any dispensing materials from the channels and from the top surface of the plates. In addition, since all of the openings in the plates are relatively shallow, it is easy to clean dispensing material from these openings.

In embodiments of the present invention described above, distribution blocks are provided for pumps having four inlets and four outlets. In other embodiments, as readily understood by those skilled in the art, distribution blocks of the present invention may be used with pumps having more or less than four inlets and outlets.

In the distribution block described above with reference to FIG. 3, passages are formed using grooves in one plate and a flat surface of another plate. In other embodiments, the passages may be formed using matching grooves in adjacent plates.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting.

What is claimed is:

1. A dispensing pump for dispensing a metered quantity of material onto a substrate, the dispensing pump comprising:

a pump housing having a plurality of inputs and a plurality of outputs;

a motor, coupled to the pump housing that controls flow of material from the plurality of inputs in the pump housing to the plurality of outputs in the pump housing; and a distribution apparatus coupled to the pump housing, the distribution apparatus having an inlet to receive material and an outlet from which material is dispensed the distribution apparatus being configured to transfer material from the inlet to the plurality of inputs of the pump housing and to transfer material from the plurality of outputs of the pump housing to the outlet, the distribution apparatus including a plurality of plates couples together to form the distribution apparatus.

2. The dispensing pump of claim 1, wherein at least one of the plurality of plates includes a heater to heat the dispensing material.

3. The dispensing pump of claim 1, wherein the distribution apparatus includes a first plate that has an inlet channel extending from the inlet to a junction point and a plurality of concave channels formed in a first surface of the plate and extending from the junction point to couple the inlet to each of the plurality of inputs.

4. The dispensing pump of claim 3, wherein the distribution apparatus further includes a second plate having a first surface mated with the first surface of the first plate to enclose each of the concave channels.

5. The dispensing pump of claim 4, wherein the second plate has a second surface having a plurality of concave channels extending from a junction point to couple each of the plurality of outputs to the junction point.

6. The dispensing pump of claim 5, further comprising a third plate having a first surface mated with the second surface of the second plate to enclose each of the concave channels of the second plate.

7. The dispensing pump of claim 6, wherein the third plate further includes a second surface substantially parallel to the first surface and includes an output channel aligned with the junction point of the second plate and extending from the first surface of the third plate to the second surface of the third plate.

8. The dispensing pump of claim 7, wherein at least one of the first plate, the second plate and the third plate includes a heater.

9. A method of dispensing material from a dispensing apparatus having a plurality of inputs and a plurality of outputs, and a motor that controls flow of material from the plurality of inputs to the plurality of outputs, the method including steps of:

coupling a plurality of plates to the dispensing apparatus, the plurality of plates forming a plurality of channels to couple the plurality of inputs to a single material input and to couple the plurality of outputs to a single material output;

applying dispensing material to the single material input; and dispensing material from the single material output.

10. The method of claim 9, further comprising steps of:

disassembling the plates from the dispensing apparatus; and cleaning the dispensing material from the plates.

11. The method of claim 9, further comprising a step of heating the dispensing material in the plurality of plates.

12. A dispensing pump for dispensing a metered quantity of material onto a substrate, the dispensing pump comprising:

an inlet for receiving dispensing material;

an outlet from which the dispensing material is dispensed;

a pump housing having a plurality of inputs and a plurality of outputs;

a motor, coupled to the pump housing that controls flow of material from the plurality of inputs in the pump housing to the plurality of outputs in the pump housing; and means for transferring material from the inlet to the plurality of inputs and for transferring material from the plurality of outputs to the outlet, the means for transferring including a plurality of sections coupled together to form a plurality of distribution channels.

13. The dispensing pump of claim 12, further comprising means for heating the dispensing material in the means for transferring.

* * * * *